US005946728A

United States Patent [19]

Tane

[11] Patent Number: 5,946,728

[45] Date of Patent: Sep. 7, 1999

[54] CONVERTIBLE HEADBAND

[76] Inventor: Victoria Tane, 27 Seven Pines Ave., Cambridge, Mass. 02140

[21] Appl. No.: 09/032,011

[22] Filed: Feb. 27, 1998

Related U.S. Application Data

[60] Provisional application No. 60/061,388, Oct. 7, 1997.

[51] Int. Cl.[6] ..... A41D 20/00

[52] U.S. Cl. ..... 2/171; 2/DIG. 11; 63/3; 63/3.1; 132/273; D11/3

[58] Field of Search ..... 2/171, DIG. 11, 2/207, 132; 24/116 R; 63/3, 3.1, 4, 38, 39; 132/273; D11/3, 6, 11, 19, 24; D2/609

[56] References Cited

U.S. PATENT DOCUMENTS

| | | | |
|---|---|---|---|
| 39,832 | 2/1863 | Leyser | D11/11 |
| D. 50,668 | 4/1917 | Steiner | 132/273 |
| D. 182,102 | 2/1958 | Behr . | |
| D. 324,434 | 3/1992 | Walker . | |
| D. 374,306 | 10/1996 | Query . | |
| 1,695,983 | 12/1928 | Saito . | |
| 2,439,088 | 4/1948 | Herr | 2/132 |
| 2,486,122 | 10/1949 | Corubia . | |
| 2,490,285 | 12/1949 | Smith . | |
| 2,547,295 | 4/1951 | Weeks . | |
| 2,775,245 | 12/1956 | Behr . | |
| 3,413,986 | 12/1968 | Triangolo . | |
| 5,564,445 | 10/1996 | Query | 132/273 |
| 5,566,690 | 10/1996 | Shih-Ming . | |

*Primary Examiner*—Diana L. Oleksa
*Attorney, Agent, or Firm*—O'Connell Law Firm

[57] ABSTRACT

A convertible headband comprising a strand of tough and ductile wire with a plurality of V-bends formed therealong. The convertible headband may be bent into an arcuate configuration and disposed about a human head to restrain a wearer's hair, the convertible headband may be bent into an annular configuration disposed about a human neck to be worn as a choker necklace; and the convertible headband may be bent into a helical configuration and disposed about a human wrist or ankle to be worn as a bracelet or anklet or disposed surrounding a ponytail to be worn as a ponytail holder. Closed loops may be disposed at first and second ends of the strand of wire, and a removable S-hook may be used for coupling the closed loops together for securing the convertible headband about a human neck, wrist, or ankle. A multiplicity of annular beads may be rotatably threaded onto the strand of wire with beads disposed only on a first leg of each V-bend whereby alternating legs of the V-bends are bare.

17 Claims, 3 Drawing Sheets

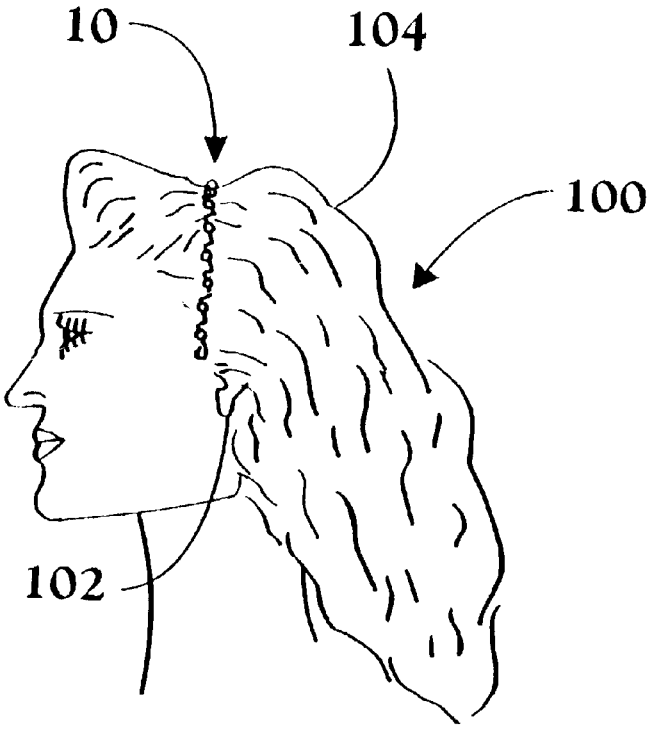
FIG. 2
FIG. 3
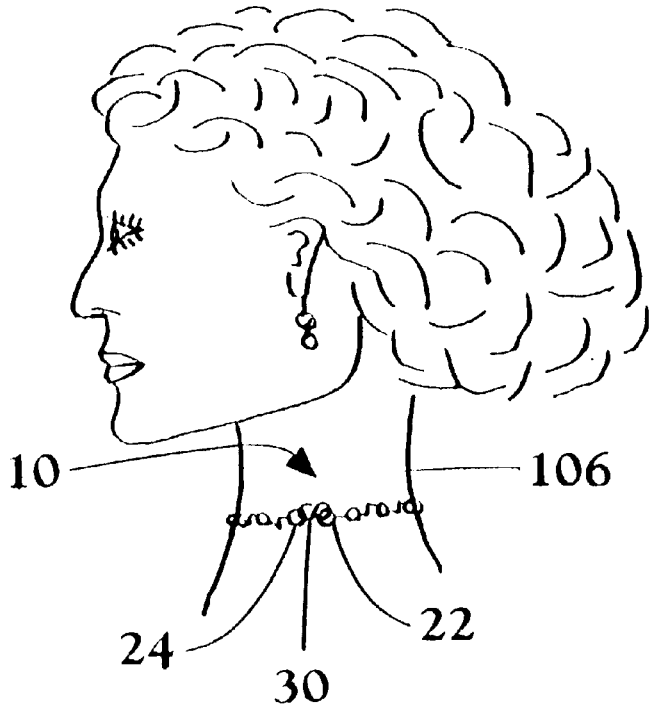

CONVERTIBLE HEADBAND

This application claims the benefit of U.S. Provisional Application No. 60/061,388 FILING DATE Oct. 7, 1997.

FIELD OF THE INVENTION

The present invention relates generally to hair fasteners. More particularly, it relates to a hairband that is mutually convertible between a primary use as a headband and a multiplicity of alternative uses.

BACKGROUND OF THE INVENTION

The prior art certainly discloses a wide variety of devices designed to maintain a wearer's hair in a desired configuration. Commonly, these devices simultaneously serve as accessories for improving and completing a wearer's overall appearance. For example, traditional headbands comprising a relatively wide horseshoe-shaped band of resiliently-flexible material such as plastic are well known. Teeth included on an inside surface of many such headbands assist the devices in controlling a wearer's hair. Other prior art devices include endless elasticized bands retained in a fabric sleeve that commonly are used for surrounding and restraining a length of hair such as a ponytail. These and other hair fastening devices undoubtedly are well known to one skilled in the art.

Unfortunately, however, such prior art devices have been seen to exhibit a number of disadvantages that have been recognized persistently by those who wear them. This is particularly the case with the horseshoe-shaped headbands that commonly are used to retain the top portion of a wearer's hair. Among the problems exhibited by such prior art headbands, which are normally made from resilient plastic, is that wearers commonly suffer from headaches caused by an incessant pressing by the headbands on the sides of the wearer's head. Many might further note that, at least relative to present-day styles, such headbands have come to be perceived as aesthetically unattractive.

At least one attempt has been made to provide a headband formed of a simple length of ductile wire. In use, this style of headband is bent to an arcuate form to accommodate the size and shape of a wearer's head. One may reasonably presume that a wearer of such a headband would be less likely to suffer from headaches even with prolonged wearing of the headband because the headband can be particularly adapted to suit the shape and size of each wearer's head and can be further widened as circumstances require. Furthermore, some might opine that such headbands present a more modern and pleasing appearance relative to today's styles than traditional wide headbands.

Disadvantageously, however, these benefits achieved by simple wire headbands are tempered by a multiplicity of shortcomings from which they suffer. A most significant problem, a problem aggravated by the sheer simplicity of the strip of wire, is that the headband demonstrates little ability to remain in a fixed position on a wearer's head. As a result, these prior art headbands often fail to restrain a wearer's hair effectively, and, to the frustration of the wearer, the bands frequently require readjustment.

With the foregoing in mind, it becomes clear that an invention providing a solution to one or more of these problems demonstrated by prior art devices would be useful. However, a hairband presenting a solution to all of the previously-described problems while exhibiting heretofore unrealized advantages undoubtedly would represent a marked advance in the art.

SUMMARY OF THE INVENTION

Advantageously, a principal object of the present invention is to provide a headband that can be worn for prolonged time periods without inflicting a headache upon the wearer. A related object is to provide such a headband that can be adjusted to adapt to the size and shape of the heads of a wide variety of wearers. Another principal object of the invention is to provide such a headband that nonetheless effectively restrains a wearer's hair over extended periods of time without undesirable displacement and consequent need for readjustment. A further object of the invention is to provide such a headband that is mutually convertible from a primary use as a headband to a multiplicity of alternative uses such as as a choker necklace, a bracelet or anklet, and a ponytail holder. Yet another object of the invention is to provide such a headband that is exceedingly durable yet aesthetically attractive. Undoubtedly, these and other objects and advantages of the present invention will become readily apparent to one who reads the present specification and reviews the accompanying drawings.

In accomplishing the aforementioned objects, the present invention for a convertible headband begins with a strand of material such as wire. A plurality of V-bends or zig-zags, each with a first leg and a second leg, are formed along the strand of wire. Preferably, the strand of wire is formed from a tough and ductile material so that it can withstand repeated elastic deformation or bending. The inventor has discovered that galvanized steel, dark annealed steel, brass, or copper wires perform well due to their ability to bend readily and repeatedly without fracture.

The preferred headband of the present invention has a strand of ductile wire with an effective length from first end to second end of between approximately ten inches (twenty-five centimeters) and approximately twenty inches (fifty-one centimeters) with fifteen inches (thirty-eight centimeters) being most preferred. Such a headband will have between twelve an twenty-four substantially identical V-bends evenly disposed therealong. The first and second legs of the V-bends may or may not be substantially equal in length. Since the V-bends are bent into place, it is certain that the first and second legs of the V-bends would not meet at sharp angles but instead would meet at relatively smooth, albeit relatively small, bends or elbows. The preferred strand of wire will have a gage thickness of between approximately 16 and approximately 18 whereby the strand of wire will have a diameter between approximately 0.07 inches (0.18 centimeters) and approximately 0.04 inches (0.10 centimeters).

Even in this most basic form, the invention achieves the substance of its primary objects. The ductile strand of wire enables ready adjustment of the convertible headband to assume horseshoe shapes that suit heads of varied size and shape. Consequently, a wearer can adjust the convertible headband so that it exerts sufficient pressure on the sides of the wearer's head to resist movement but not so much pressure as to cause discomfort and headache. Furthermore, the V-bends of the narrow wire have been discovered to allow the convertible headband to nest among the strands of a wearer's hair thereby to lock the convertible headband in place. Consequently, the invention achieves the dual-and arguably competing—objectives of applying little enough pressure on a wearer's head thereby to avoid causing a headache while simultaneously maintaining the hairband and thus the wearer's hair in a substantially fixed position. Still further, the toughness and ductility of the wire strand allow the convertible headband to be bent from the arcuate configuration of a headband into an annular configuration for use as a choker necklace and alternatively into a quasi-helical configuration to allowing wearing of the convertible headband as a bracelet, anklet, or ponytail holder.

Nonetheless, this essential embodiment of the invention can be further improved still further with the provision of a means for selectively coupling the first end of the strand of material to the second end of the strand of material. With such a means provided, the convertible headband may be secured in place in a fixed configuration about a human neck, wrist, ankle, or ponytail. Certainly, many different means could perform such a function. For example, acceptable selective coupling means could comprise a hook and loop combination, a belt-type clasp, a button combination, a pair of opposed hooks, a hook and circular loop, or any other appropriate arrangement. Nonetheless, the inventor has devised of a most preferable selective coupling means that comprises a closed loop disposed at the first end of the strand of material, a closed loop disposed at the second end of the strand of material, and a removable S-hook for coupling the closed loop of the first end to the closed loop of the second end. Such an arrangement is particularly advantageous because, with its smooth closed loops, it ensures a reliable coupling of the ends of the strand of material while effectively eliminating the snagging and scratching that would be likely to result where other means were employed.

The functionality of the invention may be improved yet further by threading a multiplicity of beads of annular cross section onto the strand of material whereby each bead is rotatably held thereon. Aside from significantly adding to the overall attractiveness of the headband, the beads also have been found to nest or anchor within the strands of a wearer's hair thereby assisting the headband in maintaining its position on a wearer's head. Furthermore, the rotatable beads provide a means for gripping the hairband to allow easy removal of the hairband from a wearer's hair.

Of course, in manufacture, it may be necessary to thread the beads onto the strand of material before the V-bends are formed and to dispose the beads along the strand of material based on a desired location of the beads on the V-bends. The inventor has discovered that the headband achieves greatest functionality when beads are disposed only on alternating legs of the V-bends whereby each leg adjacent a beaded leg is bare. With this, beads will not tend to wedge or snag a wearer's hair between one another. Advantageously, once formed, the sharp turns of the V-bends restrict each bead from sliding beyond the leg of the V-bend upon which it is located when the V-bend is formed.

One skilled in the art will realize that the foregoing discussion broadly outlines the more important features of the invention to enable a better understanding of the detailed description that follows and to instill a better appreciation of the inventor's contribution to the art. Before an embodiment of the invention is explained in detail, it must be clear that the following details of construction, descriptions of geometry, and illustrations of inventive concepts are mere examples of possible manifestations of the invention.

BRIEF DESCRIPTION OF THE DRAWINGS

FIG. 2 is a view in side elevation of the convertible headband of FIG. 1 being worn as a headband;

FIG. 3 is a view in front elevation of the convertible headband of FIG. 1 being worn as a choker necklace;

DETAILED DESCRIPTION OF A PREFERRED EMBODIMENT

Figure 1:
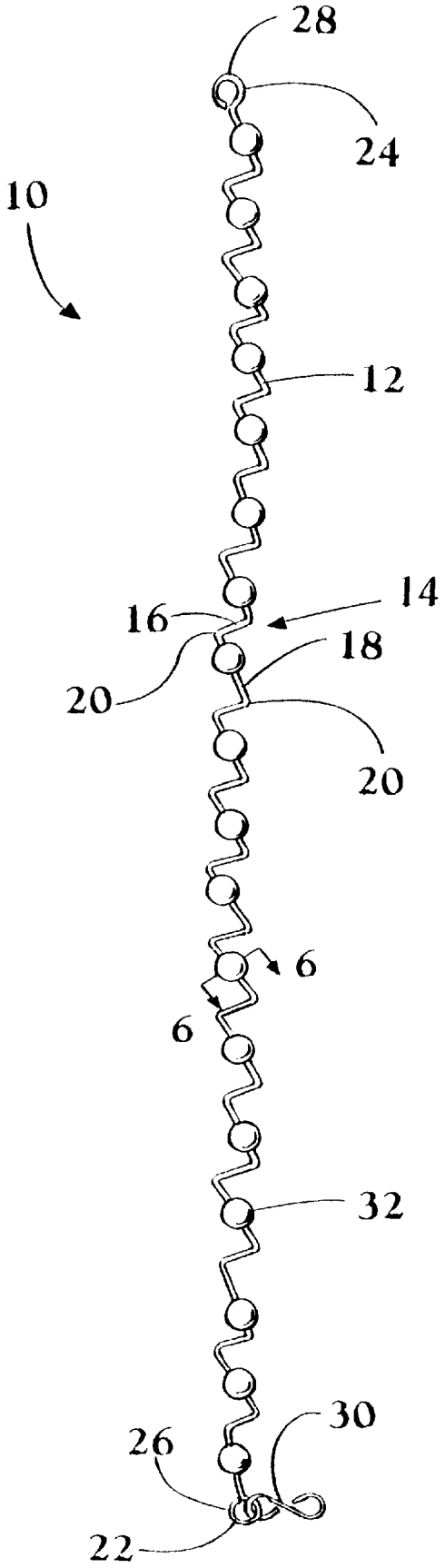
FIG. 1 is a view in front elevation of a convertible headband according to the present invention.

Looking more particularly to the drawings, a preferred embodiment of the present invention for a convertible headband is indicated generally at 10 in each figure. Turning first to FIG. 1, a single strand of material such as a strand of wire 12 forms a framework for the convertible headband 10. Although the strand of wire 12 may be formed from a wide variety of materials including plastic, metal, or even wood, for optimal function it should be formed from a material that is tough and ductile whereby the preferred strand of wire 12 of the headband 10 can be bent repeatedly for conversion between a multiplicity of uses. With this in mind, the preferred strand of wire 12 is crafted from galvanized steel, dark annealed steel, brass, or copper with a gage of approximately 16 (0.07 inches), 18 (0.04 inches), or anywhere in between.

The preferred strand of wire 12 has a plurality of V-bends or zigzags, such as that which is indicated generally at 14, bent into place therealong. Each of the plurality of V-bends 14 has a first leg 16 and a second leg 18 meeting at a bend 20. Since the V-bends 14 are bent into place, it is likely that each bend 20 will be somewhat rounded and not necessarily sharp. Similarly, each of the plurality of V-bends 14, except that V-bend 14 adjacent a first end 22 of the strand of wire 12 and that V-bend adjacent a second end 24 of the strand of wire 12, meets an adjacent V-bend 14 at a bend 20. It is presently considered ideal that the strand of wire 12 have a length from first end 22 to second end 24 of approximately fifteen inches and between fifteen and twenty-two substantially identical V-bends 14 spaced evenly therealong. Clearly, the V-bends 14 may have first legs 16 and second legs 18 of substantially equal lengths. Of course, it is also within the scope of the invention that the first and second legs 16 and 18 may have different lengths.

Figure 6:
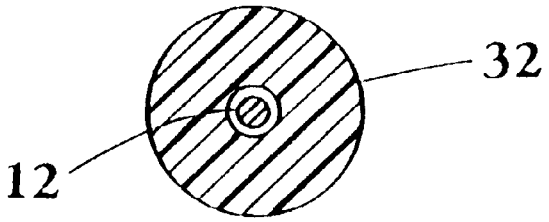
FIG. 6 is a view in cross section of the convertible headband of the present invention taken along the line 6—6 in FIG. 1.

During manufacture, a plurality of beads 32 are threaded onto the strand of wire 12 while the strand of wire 12 is straight. As the V-bends 14 are bent into place, the beads 32 are slid along the strand of wire 12 so that one bead 32 is disposed on the second leg 18 of each V-bend 14 and no beads 32 are disposed on the first leg 16 of each V-bend 14. Where beads 32 are disposed only on second legs 18, it may be preferred to form second legs 18 to be longer than first legs 16. Certainly, beads 32 of any size, shape, and texture may be disposed on the strand of wire 12. Preferably, the beads 32 have a diameter of between about four and fourteen millimeters. As FIG. 6 shows most clearly, in one preferred embodiment, the beads 32 have an annular cross section.

The invention is improved still further by the provision of a means for selectively coupling the first end 22 of the strand of material 12 to the second end 24 of the strand of material in the form of a first closed loop 26 that is bent into place at the first end 22 of the strand of wire 12, a second closed loop 28 that is bent into place at the second end 24 of the strand of wire 12, and a means for coupling the first closed loop 26 and the second closed loop 28 in the form of an S-hook 30. Under such an arrangement, the convertible headband 10 is subject to a variety of uses.

One such use is exemplified in FIG. 2 where one sees the convertible headband 10 employed in its primary function as a headband. For such a use, the ductile strand of wire 12 of the convertible headband 10 is bent into a generally horseshoe shape that is intended to approximate the size and shape of the middle of the top of the prospective wearer's head 100. As FIG. 2 shows, the strand of wire 12 is preferably bent such that the first and second legs 16 and 18 of the V-bends 14 are generally tangential to the radius of curvature of the formed horseshoe shape whereby they would tend to be generally parallel to the surface of a wearer's head 100.

In any event, in the preferred manner of wearing the headband 10, the first and second ends 22 and 24 of the headband 10 are first placed behind the wearer's ears 102, and then the entire convertible headband 10 is pushed back along a wearer's head 100 to a position just beyond the desired location of the headband 10. The headband 10 is then pushed forward approximately one-half inch. With this simple procedure completed, the V-bends 14 and the beads 32 of the narrow strand of wire 12 nest among the strands of a wearer's hair 104 thereby effectively locking the convertible headband 10 in place. As a side note, one may observe that the S-hook 30 is substantially superfluous under this use. Therefore, a user may choose to remove and retain that element when the convertible headband 10 is worn as a headband.

Importantly, a wearer can adjust the convertible headband 10 at any time to suit the size and shape of the wearer's head 100. For example, the wearer can make the convertible headband 10 wider by simply pulling the first end 22 and the second end 24 of the strand of wire 12 apart, and the wearer can narrow the convertible headband 10 by removing it from her head 100 and pressing the first end 22 and the second end 24 of the strand of wire 12 toward each other. Still further, the wearer can manipulate the overall shape to which the strand of wire 12 is bent to suit the particular shape of the wearer's head 100. In any event, the ductility and toughness of the preferred strand of wire 12 allow a user to adjust the convertible headband 10 as circumstances require to ensure that it exerts sufficient pressure on the sides of the wearer's head 100 that undesired movement is prevented but not so much pressure as to cause discomfort and headache.

Although the invention certainly is uniquely convenient and comfortable in use as a headband, there are likely to be situations where one wearing the convertible headband 10 may no longer desire to have her hair restrained. With most conventional hair restraining devices, a wearer removing her headband would be inconveniently required to find a location to store the device. If an acceptable location were unavailable, then the wearer might be required either to continue wearing the headband or to carry the device by hand. One may note also that there may be situations wherein a person from the outset seeks to wear fashion accessories alternatively to or in addition to a headband. Unfortunately, most prior art devices are disadvantageous in this regard also because they require a user to procure and employ separate fashion accessories in addition to the hair restraining device.

Advantageously, one possessing a convertible headband 10 according to the present invention can readily convert the device to and from one of a plurality of alternative uses. As a result, a separate means for storing the convertible headband 10 when one removes the device is not required because its alternative uses effectively function as a unique type of storage means. Furthermore, with regard to a user who wishes to wear a different type of accessory than a headband at the outset, one possessed of the convertible headband 10 has the option of choosing to employ the device as an entirely different accessory from the start. As a result, it becomes clear that the purchase of apparently a single fashion accessory in the convertible headband 10 in reality comprises the purchase of a plurality of readily-available and mutually-convertible accessories.

A first alternative use is shown in FIG. 3 wherein the convertible headband 10 is worn as a choker necklace. To accomplish such a use of the device, a user will bend the tough and ductile strand of wire 12 into a generally annular configuration. Then, the user will pass the first and second ends 22 and 24 of the convertible headband 10 around her neck 106 whereby the convertible headband 10 will generally surround her neck 106. With this, an attractive choker necklace is formed. Certainly, to avoid losing the device one may wish to secure the necklace about her neck 106 by coupling the closed loop 26 of the first end 22 to the closed loop 28 of the second end 24 by use of the S-hook 30.

Figure 4:
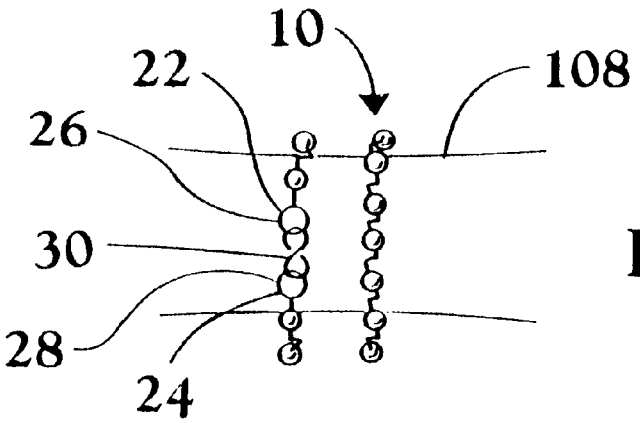
FIG. 4 is a view in side elevation of the convertible headband of FIG. 1 being worn as a bracelet or anklet.

A third contemplated use of the invention is illustrated in FIG. 4 wherein the convertible headband 10 is shown being worn as a bracelet or anklet. Certainly such a use might be accomplished with the present invention in a variety of ways. However, it might be considered most advantageously carried out by forming the device into a generally annular or horseshoe-shaped configuration, disposing the strand of wire 12 against a user's limb 108, and wrapping the ductile strand of wire 12 of the convertible headband 10 around the limb 108 however many times are comfortably practicable, which will depend on the effective length of the convertible headband 10 and the circumference of the wearer's limb 108. With this, the convertible headband 10 readily acts as a unique and appealing wrap-around bracelet. Of course, the device again may be secured to prevent loss by coupling the closed loop 26 of the first end 22 to the closed loop 28 of the second end 24 by use of the S-hook 30.

Figure 5:
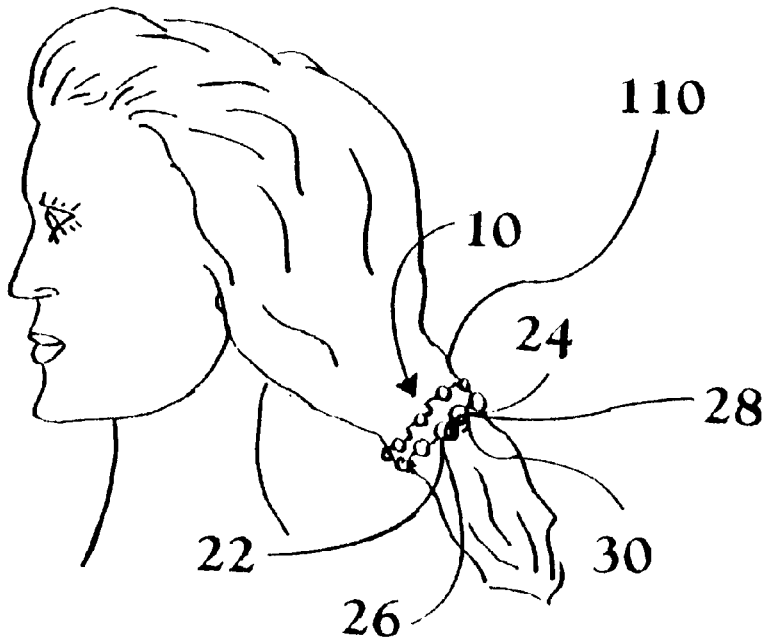
FIG. 5 is a view in side elevation of the convertible headband of FIG. 1 being worn as a ponytail holder.

In a somewhat similar manner, the convertible headband 10 may be worn as a ponytail holder as is illustrated in FIG. 5. Again, one might achieve the desired ponytail-restraining result in a multiplicity of ways. For example, one might begin by forming a ponytail 110. She might then dispose the strand of wire 12, which should be in arcuate form, against the ponytail 110 after which she would wrap the strand of wire 12 around the ponytail 110 however many times that the circumstances reasonably allow. The wearer then most likely would wish to secure the convertible headband 10 in place by coupling the closed loop 26 of the first end 22 to the closed loop 28 of the second end 24 by use of the S-hook 30.

From the foregoing, it is apparent that the invention achieves a plurality of advantages over the prior art. For example, due to the ready adjustability of the size and shape of the convertible headband 10, the device certainly can be adjusted to suit nearly any wearer, and it can be worn over a prolonged period of time with little likelihood of inflicting a headache upon the wearer. Furthermore, as the V-bends 14 and the beads 32 nest in a wearer's hair 104, the convertible headband 10 effectively restrains a wearer's hair 104 for an extended time without undesirable displacement and consequent need for readjustment. Still further, the convertible headband 10 is mutually convertible from a primary use as a headband to a multiplicity of alternative uses such as as a choker necklace, a bracelet or anklet, and a ponytail holder. Those who make use of the present invention and those who have read the instant disclosure certainly will find these and additional advantages readily apparent.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim as deserving the protection of United States Letters Patent:

1. A convertible headband comprising a strand of material with a first end; a second end; and a plurality of V-bends, each with a first leg and a second leg, formed therealong wherein the strand of material comprises a strand of ductile wire whereby the strand of material may be bent into an arcuate configuration and disposed about a human head to restrain a wearer's hair, whereby the strand of material may be bent into an annular configuration and disposed about a human neck to be worn as a choker necklace, and whereby the strand of material may be bent into a helical configuration and disposed about a human wrist or ankle to be worn as a bracelet or anklet or disposed surrounding a ponytail to be worn as a ponytail holder.

2. The convertible headband of claim 1 wherein the first leg and the second leg of each of the plurality of V-bends are substantially equal in length.

3. The convertible headband of claim 1 wherein the strand of ductile wire is formed from a material chosen from the group consisting of steel, brass, and copper.

4. The convertible headband of claim 1 wherein the strand of ductile wire is formed from a material chosen from the group consisting of galvanized steel and dark annealed steel.

5. The convertible headband of claim 1 further comprising a multiplicity of beads threaded onto the strand of material.

6. The convertible headband of claim 5 wherein each of the multiplicity of beads is rotatably threaded onto the strand of material.

7. The convertible headband of claim 6 wherein each of the multiplicity of beads has an annular cross section.

8. A convertible headband comprising a strand of material with a first end; a second end; and a plurality of V-bends, each with a first leg and a second leg, formed therealong and further comprising a means for selectively coupling the first end of the strand of material to the second end of the strand of material comprising a closed loop disposed at the first end of the strand of material, a closed loop disposed at the second end of the strand of material, and a means for coupling the closed loop of the first end of the strand of material to the closed loop of the second end of the strand of material whereby the convertible headband may be secured in place about a human neck, wrist, ankle, or the like.

9. The convertible headband of claim 8 wherein the means for coupling the closed loop of the first end of the strand of material to the closed loop of the second end of the strand of material comprises a removable S-hook.

10. A convertible headband comprising a strand of material with a first end; a second end; a plurality of V-bends, each with a first leg and a second leg, formed therealong; and a multiplicity of beads threaded onto the strand of material wherein at least one bead is disposed on the first leg of a multiplicity of the plurality of V-bends and no beads are disposed on the second leg of the multiplicity of the plurality of V-bends whereby alternating legs of the multiplicity of the plurality of V-bends are bare.

11. A convertible headband for being employed for a multiplicity of alternative uses in addition to the primary use as a headband, the convertible headband comprising:

a strand of ductile wire with a first end and a second end;

a plurality of V-bends, each with a first leg and a second leg, formed along the strand of wire; and a means for coupling the first end of the strand of wire to the second end of the strand of wire;

whereby the strand of wire may be bent into an arcuate configuration and the convertible headband may be disposed about a human head to restrain a wearer's hair, whereby the strand of wire of the convertible headband may be bent into an annular configuration and the convertible headband may be disposed about a human neck to be worn as a choker necklace, and whereby the strand of wire of the convertible headband may be bent into a helical configuration and the convertible headband may be disposed about a human wrist or ankle to be worn as a bracelet or anklet or disposed surrounding a ponytail to be worn as a ponytail holder.

12. The convertible headband of claim 11 wherein the strand of ductile wire has an effective length from first end to second end of between approximately ten inches and approximately twenty inches.

13. The convertible headband of claim 11 wherein the effective length of the ductile wire is approximately fifteen inches.

14. The convertible headband of claim 11 wherein there are between twelve and twenty-four V-bends formed along the strand of wire.

15. The convertible headband of claim 11 further comprising a multiplicity of beads rotatably threaded onto the strand of wire.

16. The convertible headband of claim 15 wherein at least one bead is disposed on the first leg of a multiplicity of the plurality of V-bends and no beads are disposed on the second leg of the multiplicity of the plurality of V-bends whereby legs of the multiplicity of the plurality of V-bends are alternatingly bare and beaded.

17. The convertible headband of claim 11 wherein the strand of ductile wire has a diameter between approximately 0.04 inches and approximately 0.07 inches.

* * * * *